US005937748A

United States Patent [19]

Leligdon et al.

[11] Patent Number: 5,937,748

[45] Date of Patent: Aug. 17, 1999

[54] METAL COIL PRINTING MECHANISM AND METAL COIL PRESS MACHINES INCLUDING REGISTRATION CONTROL

[75] Inventors: David Leligdon, Fenton; John Gregory Byrne, Mehlville; Frank Schertler, St. Louis, all of Mo.

[73] Assignee: Sequa Corporation, Hackensack, N.J.

[21] Appl. No.: 09/070,965

[22] Filed: May 1, 1998

[51] Int. Cl.[6] ..... B41F 1/07

[52] U.S. Cl. ..... 101/32; 101/37; 101/248; 72/6.1; 226/24; 226/45

[58] Field of Search ..... 101/32, 37, 6, 101/23, 129, 248; 427/287, 293; 118/669, 40, 210, 712, 672, 674; 72/6.1, 185; 226/24, 45

[56] References Cited

U.S. PATENT DOCUMENTS

| | | | |
|---|---|---|---|
| 3,030,915 | 4/1962 | Shannon . | |
| 3,543,554 | 12/1970 | Hoagland et al. | 72/185 |
| 3,899,946 | 8/1975 | Niepmann . | |
| 3,934,505 | 1/1976 | Kushner . | |
| 4,380,943 | 4/1983 | Evans . | |
| 4,426,898 | 1/1984 | Friberg . | |
| 4,459,885 | 7/1984 | Friberg . | |
| 4,543,863 | 10/1985 | Rader . | |
| 4,757,930 | 7/1988 | Ditto . | |
| 4,781,090 | 11/1988 | Feldkamper et al. . | |
| 4,781,317 | 11/1988 | Ditto . | |
| 5,037,665 | 8/1991 | LaMantia et al. . | |
| 5,081,923 | 1/1992 | LaMantia et al. . | |
| 5,470,300 | 11/1995 | Terranova . | |

OTHER PUBLICATIONS

Andantex USA, Guide to the Application of Differentials, Nov. 1995.

*Primary Examiner*—Eugene Eickholt
*Attorney, Agent, or Firm*—Mitchell D. Bittman; Herbert B. Roberts

[57] ABSTRACT

A metal coil printing mechanism for providing alignment between two patterns to be printed on a surface of the coil includes a blanket cylinder for applying a pattern to the metal coil and first and second plate cylinders which apply first and second patterns to the blanket cylinder. The first plate cylinder is geared directly to the blanket cylinder for rotation therewith. The second plate cylinder is geared for rotation with the blanket cylinder through a phase shifting device. The phase shifting device can be adjusted such that the circumferential position of the second pattern relative to the first pattern is adjusted such that desired alignment of the two patterns can be obtained. A metal coil press registration system for metal coil press machines having press devices which operate to repetitively punch or shear a metal coil includes an optical scanner for detecting spaced registration marks on the metal coil, at least one sensing device for monitoring the up and down position of the press device, and an encoder for monitoring metal coil infeed. A processing device, such as a computer, makes measurements of coil feed in so that appropriate alignment of the metal coil with the press device centerline can be maintained.

34 Claims, 8 Drawing Sheets

METAL COIL PRINTING MECHANISM AND METAL COIL PRESS MACHINES INCLUDING REGISTRATION CONTROL

FIELD OF THE INVENTION

This invention relates generally to the fields of metal coil printing, punching, and shearing, and more particularly, to a metal coil printer mechanism for providing registration between two patterns to be printed on a metal coil by a blanket cylinder, and to a registration control system and method for controlling feed in of a metal coil of the type having spaced registration marks on a surface thereof to a press machine of the type including a press device which operates to repeatedly punch or shear the metal coil.

BACKGROUND OF THE INVENTION

In the fields of metal coil printing, punching, and shearing there has been little satisfactory incorporation of registration systems which utilize spaced registration marks on a surface of the metal coil. As used herein the terminology "metal coil" refers to an elongated sheet of steel, aluminum, other metal or metal alloy of relatively uniform thickness which can be rolled or coiled upon itself and which can be unrolled or uncoiled to be passed through machinery adapted for such purpose.

One type of machinery through which a metal coil may be passed is a printer mechanism adapted to apply a pattern to a surface of the coil. U.S. Pat. No. 5,037,665 describes a printer mechanism which may be utilized to apply a pattern to a metal coil where the resulting metal coil includes spaced registration marks on its surface. However, such patent does not address potential pattern misalignment which may occur between two different patterns being applied to a coil, such as where two different ink colors are applied to the same coil surface.

After patterns have been printed onto a surface of a metal coil, a later operation which the metal coil is typically subjected to is to be passed through a metal coil press machine which includes a press device which typically operates substantially perpendicular to the surface of the metal coil and repeatedly shears the metal coil or punches the metal coil. For example, such a metal coil press device may be used to cut a metal coil into discrete sheets or such a metal coil press device may be used to punch out portions of the metal coil such as to form can lids with a desired pattern thereon. If the press device does not punch or shear the metal coil in the desired place there is the possibility that the end product may be defective. In a press punch device the end result may be can lids which do not include the full portion of the desired pattern. In a press shear device the end result may be a shear which is made through a portion of a pattern. One way to address such problems is to only feed discrete sheets of metal into such machines such that errors do not accumulate. However, it is desirable for purposes of speed and to otherwise reduce manufacturing costs to directly feed the metal coil into such press devices. U.S. Pat. No. 5,037,665 addresses the problem from the perspective of trying to assure that the pattern printed on a metal coil is uniform and within tolerances in order to reduce errors which could be caused by non-uniformity of the pattern. However, it would be desirable to utilize metal coils in such press machines even where the pattern on the surface of the metal coil is not within desired tolerances. Further, even where tight tolerance is maintained in association with the pattern printed on the surface of a metal coil it is possible for other factors, such as cumulative error, to cause a punch or shear to occur at undesirable locations.

Accordingly, the present invention is directed to overcoming one or more of the problems as set forth above.

SUMMARY OF THE INVENTION

In one aspect of the present invention a metal coil printing mechanism for providing registration between at least two patterns to be printed on a metal coil is provided. The mechanism includes a speed controllable motor. A blanket cylinder assembly includes a blanket cylinder, a drive shaft extending from the blanket cylinder and connected to the motor for rotation thereby, and a gear connected to the blanket cylinder drive shaft. The blanket cylinder is positionable to contact a surface of a metal coil passing thereby so as to apply an ink pattern thereto. A first plate cylinder assembly includes a first plate cylinder, a drive shaft extending from the first plate cylinder, and a gear connected to the drive shaft and engageable with the gear of the blanket cylinder drive shaft for rotation therewith. A second plate cylinder assembly includes a second plate cylinder, a drive shaft extending from the second plate cylinder, and a phase shifting device having an output and first and second inputs. The phase shifting device output is connected to the second plate cylinder drive shaft and the first input is connected to a gear which is engageable with the blanket cylinder drive shaft gear for rotation therewith. The first plate cylinder is positionable to apply a first ink pattern to a circumferential surface of the blanket cylinder and the second plate cylinder is positionable to simultaneously apply a second ink pattern to the circumferential surface of the blanket cylinder. By rotating the second input of the second plate cylinder assembly phase shifting device, adjustment of a circumferential position of the second ink pattern on the circumferential blanket cylinder surface relative to the first ink pattern may be made such that the combined pattern applied to the surface of the metal coil by the blanket cylinder is aligned as desired.

In another aspect of the present invention a metal coil press registration control system for automatically adjusting feed in of a metal coil of the type having spaced registration marks on a surface thereof to a metal coil press machine of the type including a press device and an indexer configured to rotate a predetermined amount between each operation of the press device in attempt to feed in the metal coil a predetermined nominal distance is provided. The system includes optical detection means positioned adjacent to the metal coil surface and aligned for detecting registration marks on the surface of the metal coil as they pass thereby. A phase shifting device includes a first input, a second input, and an output, with the first input connected to an output shaft of the indexer for rotation therewith. A coil feed roller includes a drive shaft connected to the output of the phase shifting device for rotation therewith. An encoder is connected to monitor rotation of the coil feed roller and a position controllable motor is connected for rotating the second input of the phase shifting device. A first sensing device is located for detecting a down position of the press device with respect to the surface of the metal coil. Processing means, such as a computer, is connected to each of the optical detection means, the encoder, and the first sensing device for receiving signals therefrom, and is also connected for controlling rotation of the position controllable motor. During operation of the press machine, the processing means is operable to measure coil feed in occurring between detection of a registration mark by the optical detection means and detection of a down position of the press device by the first sensing device. The processing means is further operable to compare the measured coil feed in to a predetermined distance and to calculate a feed in correction based upon the comparison. The processing means effects rotation of the position controllable motor by an amount corresponding to the calculated feed in correction only after the press device is no longer in the down position.

In another aspect of the present invention a metal coil press machine for use in association with a metal coil of the type having spaced registration marks on a surface thereof is provided. The machine includes a press device operating to repetitively shear or punch the metal coil as it passes therethrough. A coil feed roller having a drive shaft associated therewith is used for feeding in the metal coil. A servo motor is connected to the feed roller drive shaft for controlling rotation thereof and an encoder is associated with the servo motor for monitoring its rotation. Optical detection means is positioned adjacent the metal coil surface and aligned for detecting registration marks on the surface of the metal coil as they pass thereby. A first sensing device is located for detecting a down position of the press device with respect to the surface of the metal coil. Processing means, such as a computer, is connected to each of the optical detection means, the encoder, and the first sensing device for receiving signals therefrom, and is also connected for controlling rotation of the servo motor. In order to keep track of the coil feed in distance which occurs between each operation of the press device two distance measurements are repeatedly made. In particular, during machine operation the processing means is operable to repeatedly measure and store both a first coil feed in distance occurring between detection of a registration mark by the optical detection means and detection of the down position of the press device by the first sensing device, and a second coil feed in distance occurring between detection of the down position of the press device by the first sensing device and detection of the next registration mark by the optical detection means. The processing means calculates an appropriate coil feed in distance or index for each operation of the press device based upon the measurements made.

DETAILED DESCRIPTION OF THE DRAWINGS

Figure 1:
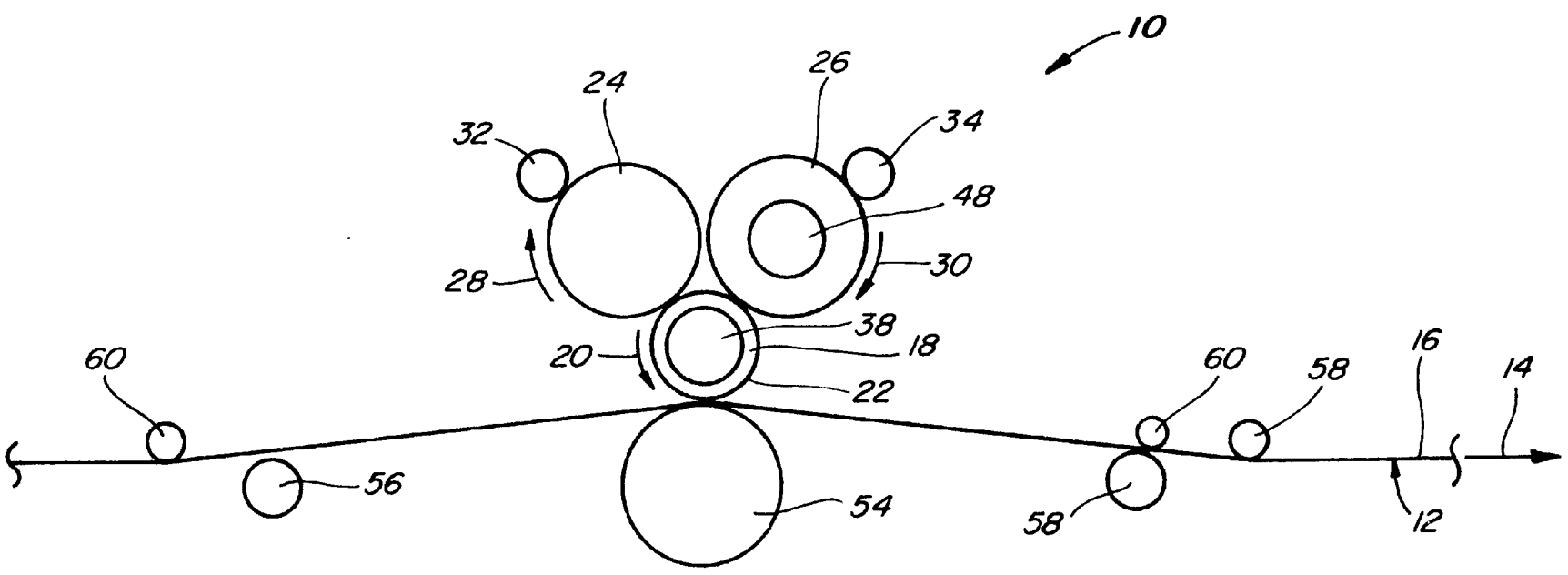
FIG. 1 is a partial schematic side view of a printing mechanism according to the present invention.

Referring to the drawings, a partial schematic side view of a metal coil printing mechanism 10 is shown in FIG. 1. A metal coil 12 passes through printing mechanism 10 from left to right as indicated by arrow 14 and a repeating pattern is printed onto a top surface 16 of metal coil 12. In particular, a blanket cylinder 18 is configured to rotate as indicated by arrow 20 and to contact surface 16 while rotating. An ink pattern which is located on the outer circumferential surface 22 of blanket cylinder 18 is applied to metal coil surface 16 during such contact. As used herein the term "ink" refers to any substance which can be transferred to the surface of a metal coil by a blanket cylinder to form a pattern thereon, including substances visible under normal lighting conditions as well as substances visible only under specific lighting conditions. The blanket cylinder ink pattern may be applied to the blanket cylinder by two plate cylinders 24 and 26 which include raised ink pick-up patterns on the outer surfaces thereof and which are configured to rotate as indicated by respective arrows 28 and 30 and which contact blanket cylinder surface 22 during rotation. Ink is applied to the raised pattern of plate cylinders 24 and 26 by respective pick up rolls or cylinders 32 and 34.

Figure 2:
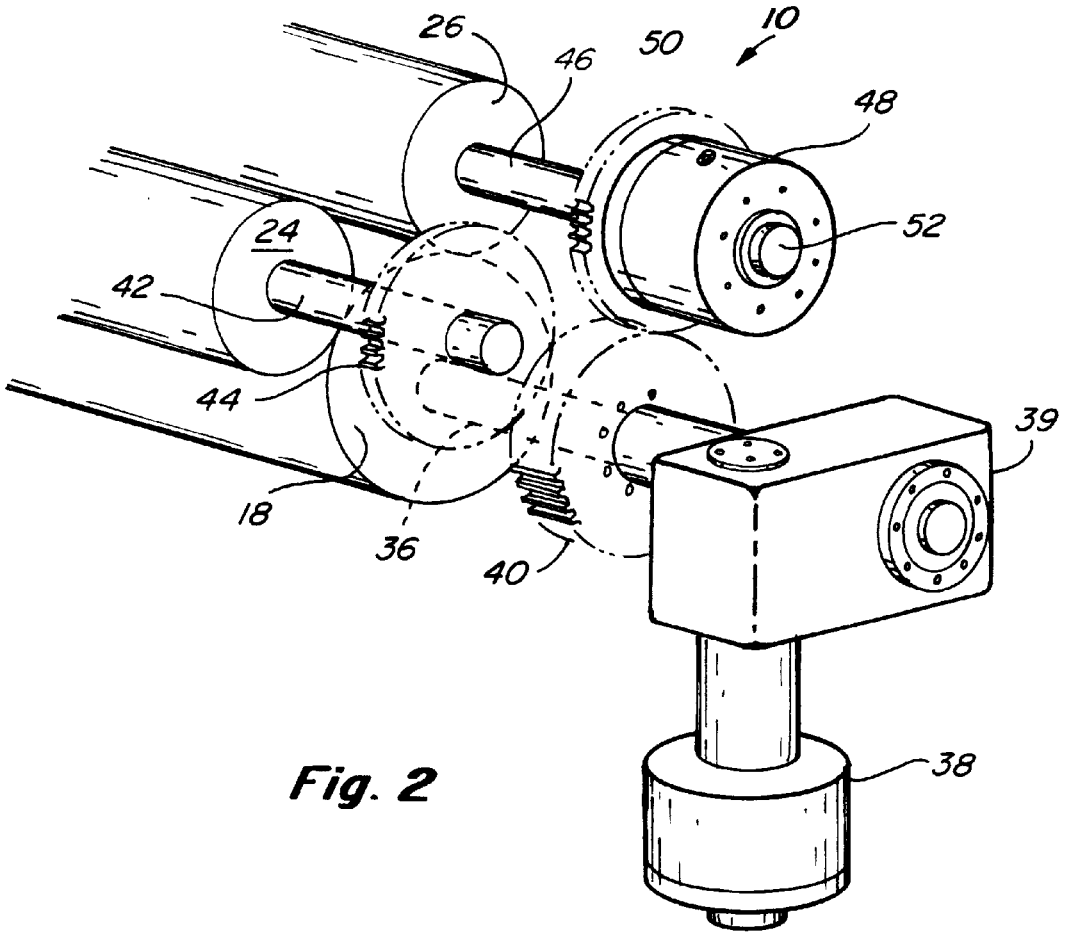
FIG. 2 is a partial perspective view of the printing mechanism of FIG. 1.

As shown in FIG. 2, blanket cylinder 18 includes a drive shaft 36 extending therefrom and connected for rotation to a motor 38. Such connection could be a direct connection, or could be made through a gearbox 39 as shown. Connected to blanket cylinder drive shaft 36 is a ring gear 40 which rotates with drive shaft 36. Extending from plate cylinder 24 is a drive shaft 42 having a ring gear 44 connected thereto. Plate cylinder ring gear 44 is positioned to engage blanket cylinder ring gear 40 such that rotation of ring gear 40 results in rotation of ring gear 44 and therefore rotation of plate cylinder 24. A drive shaft 46 also extends from plate cylinder 26 and is connected to a harmonic differential 48. In particular, drive shaft 46 is connected to an output of harmonic differential 48 for rotation therewith. A ring gear 50 is connected to an input of harmonic differential 48 for rotation therewith. Ring gear 50 is also positioned to engage blanket cylinder ring gear 40 for rotation therewith. Accordingly, rotation of plate cylinder 24 is affected by the interaction of ring gears 40 and 44 and rotation of plate cylinder 26 is affected by the interaction of ring gears 40 and 50.

Printing mechanism 10 advantageously allows for pattern alignment adjustments to be made. In particular, when both plate cylinders 24 and 26 are being used to apply two patterns to blanket cylinder outer surface 22, it is desirable to assure that the patterns are properly circumferentially aligned on blanket cylinder outer surface 22 so that the overall pattern applied to metal coil surface 16 is aligned as desired. Even where care is taken in setting up the initial positions of plate cylinders 24 and 26 small misalignments are possible. Printing mechanism 10 allows for such misalignments to be adjusted on the fly. By rotating the second input or trim input 52 of harmonic differential 48, adjustment of the circumferential position of the pattern applied to blanket cylinder surface 22 by plate cylinder 26 relative to the pattern applied to blanket cylinder surface 22 by plate cylinder 24 can be made in order to assure desired alignment of the two patterns. In particular, rotating trim input 52 in the same direction as the first input will cause the output to advance and rotating trim input 52 in the opposite direction of the first input will cause the output to retard. Harmonic differential 48 thus acts as a mechanical phase shifting device. Rotation of trim input 52 can be achieved manually by an operator or trim input 52 could be connected for rotation by a position controllable motor (not shown). Such alignment capability is considered important in the field of metal coil printing.

Referring again to FIG. 1, printing mechanism 10 may also include a variety of other components. For example, an impression cylinder 54 is provided in order to assure metal coil surface 16 maintains desired contact with blanket cylinder surface 22. Entrance and exit cylinders 56 and 58 may also be provided to properly align metal coil 12. Encoders 60 may also be utilized for monitoring metal coil movement. Continuous feed in of metal coil 12 could be achieved utilizing means which are known in the art of metal coil coating and printing, such as a web type feeding system. Such a printing mechanism may also include means or apparatus for controlling lateral positioning of metal coil 12 as it passes therethrough.

Figure 3:
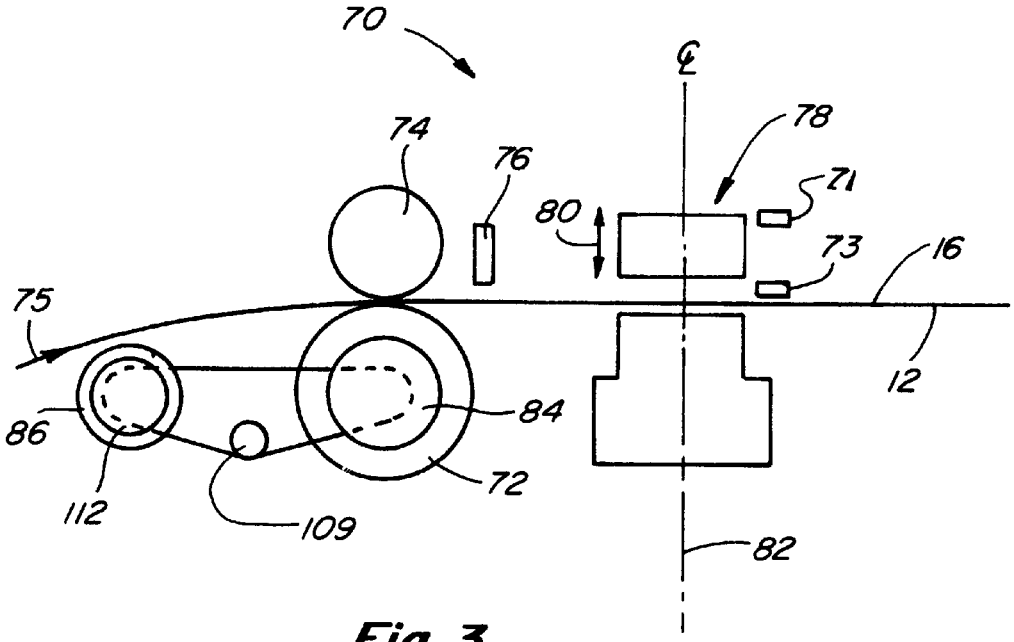
FIG. 3 is a partial schematic side view of a press machine including a press registration control system in accordance with one embodiment of the present invention.

Once a pattern has been applied to a surface of a metal coil it may be desirable to punch out portions of the metal coil or to shear the metal coil into discrete lengths. A schematic side view of a press machine 70 which can be used for such purposes is shown in FIG. 3. A feed roller 72 and associated nip roller 74 are provided to feed metal coil 12 into machine 70 from left to right as indicated by arrow 75. Beyond feed roller 72 is an optical scanner 76, or other optical detection means, positioned adjacent metal coil surface 16 and aligned for detecting spaced registration marks on surface 16. Suitable detection means such as a 1020 scanner head available from Baldwin Web Controls of Lombard, Ill. could be utilized for this purpose. A press device 78 is located beyond optical detection means 76. Press device 78 could be either a shearing device or a punching device. As indicated by arrow 80 press device 78 operates substantially perpendicular to surface 16 of metal coil 12 and with each downward movement would shear or punch the portion of metal coil 12 aligned with press device centerline 82. The use of such a press device is well known in the art of metal coil punching and shearing and therefore further detail regarding such press device 78 need not be discussed herein. In the present invention, sensing devices, such as proximity switches 71 and 73 which may be appropriately mounted to the press device, are utilized to detect up and down positions of press device 78 relative to metal coil surface 16.

Figure 4:
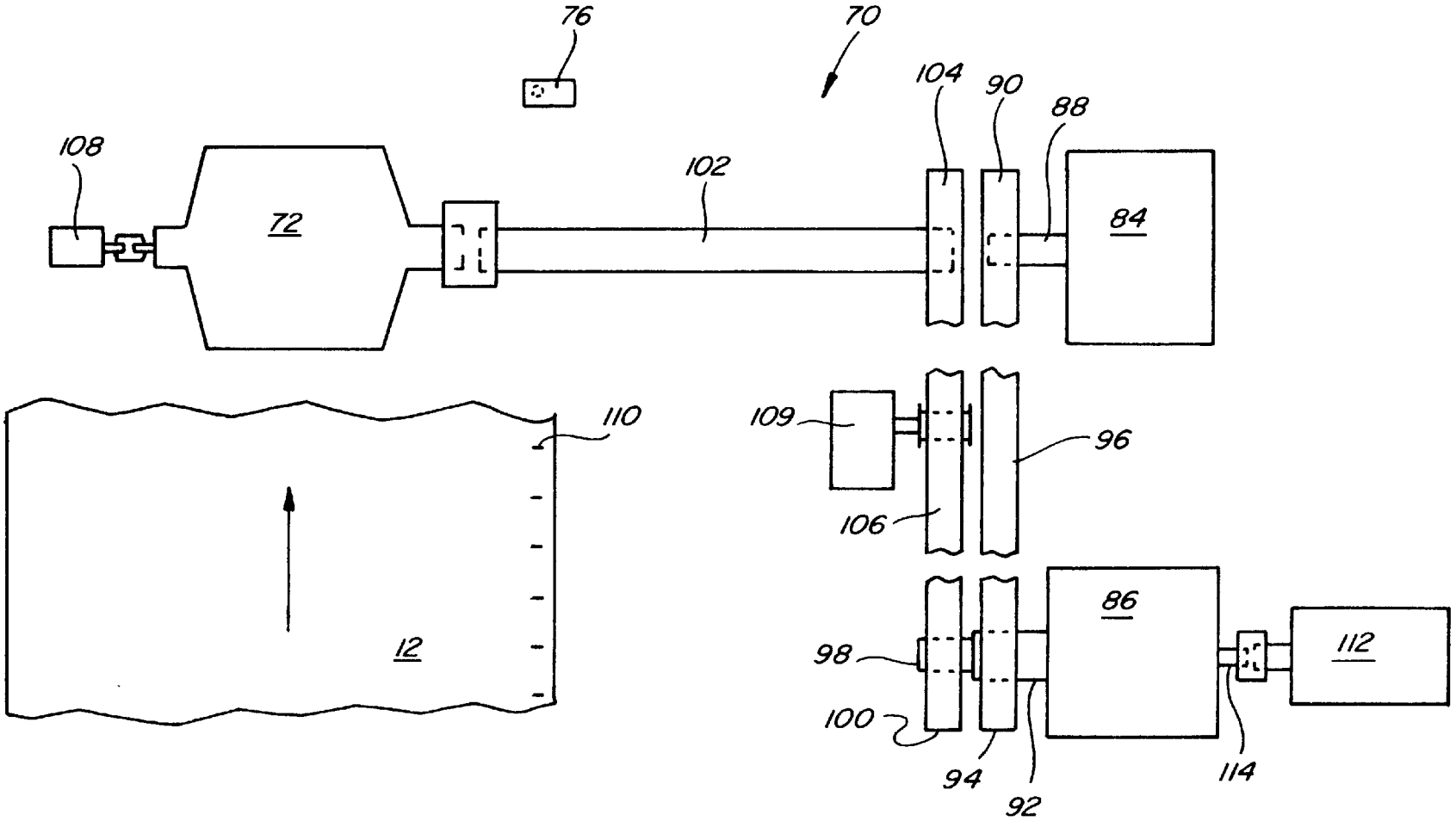
FIG. 4 is a partial top view of the press machine of FIG. 3.

As best seen in the top view of FIG. 4, rotation of feed roller 72 is effected through rotation of indexer 84 and a harmonic differential 86. In particular, an output shaft 88 of indexer 84 includes a toothed pulley 90 connected for rotation therewith and an input 92 of harmonic differential 86 includes a toothed pulley 94 connected for rotation therewith. A belt 96 extends between toothed pulleys 90 and 94 so that rotation of indexer shaft 88 results in corresponding rotation of harmonic differential input 92. Rotation of harmonic differential input 92 results in rotation of harmonic differential output 98 which also includes a toothed pulley 100 connected for rotation therewith. A drive shaft 102 extending from feed roller 72 includes a toothed pulley 104 connected for rotation therewith and a belt 106 extends between toothed pulleys 100 and 104 such that rotation of harmonic differential output 98 results in rotation of feed roller 72.

Indexer 84 may be either a mechanical indexer or a motor which is configured to rotate a predetermined amount between each punch or shear operation of press device 78. Such a preset indexer is currently used on press machines, but is typically directly coupled to feed roller drive shaft 102 rather than being geared through harmonic differential 86. Accordingly, the press machine configuration of FIGS. 3 and 4 is particularly useful in adapting or retrofitting existing press machines for use with a press registration control system, although such a configuration could also be incorporated into a newly manufactured machine. In this regard, in the case of a retrofit it is desirable to maintain correspondence between rotation of indexer shaft 88 and feed roller drive shaft 102. In order to account for the input to output ratio of harmonic differential 86, proper selection of toothed pulleys is necessary. For example, if the input 92 to output 98 ratio of harmonic differential 86 is 80/81 it is anticipated that toothed pulleys 90, 100, and 104 should be selected as 80 tooth pulleys and that pulley 94 be selected as an 81 tooth pulley. Although the use of toothed pulleys and belts is preferred, it is anticipated that a similar configuration could be achieved using other suitable means such as chains and sprockets for example.

Also shown in FIG. 4 is an encoder 108 which is utilized to monitor rotation of feed roller 72 and optical scanner 76 for sensing alignment of metal coil registration marks 110 therewith. Encoder 108 may be a 2500 PPR quadrature type for example. A position controllable motor 112, such as a stepper motor, is connected to harmonic differential second input 114, or trim input, for advancing or retarding rotation of output 98. A belt tensioner 109 is also shown.

Figure 5:
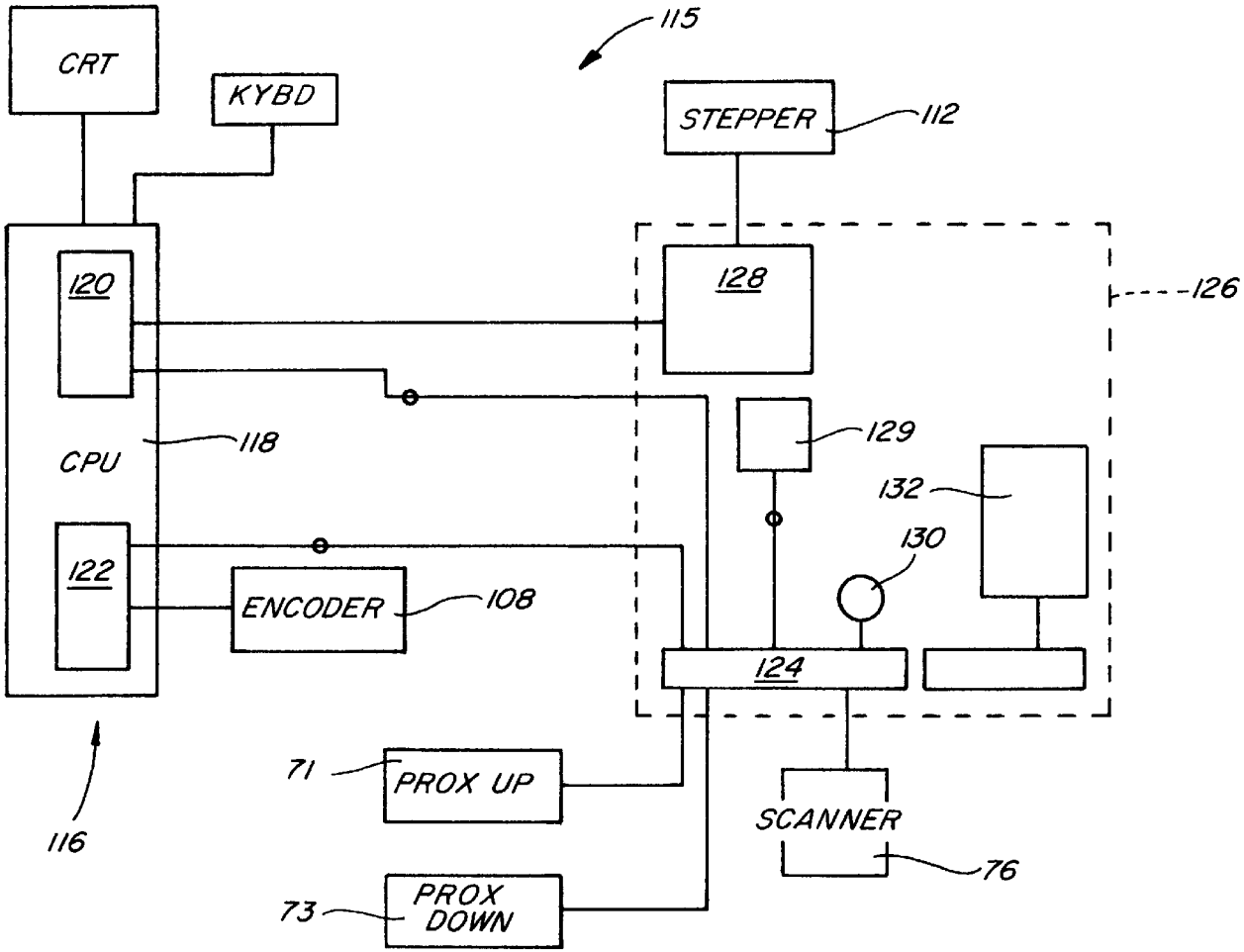
FIG. 5 is a system diagram for the press registration control system of FIGS. 3 and 4.

Referring to the press registration system 115 schematic of FIG. 5, processing means 116, such as a computer including CPU 118 having an associated stepper motor controller card 120 and an associated encoder controller card 122 is used to provide registration in press machine 70. Proximity switches 71 and 73 are connected through a control terminal 124 of an interface control panel 126 to stepper motor controller 120 for delivering signals thereto, stepper controller 120 being connected to stepper motor power supply 128 for controlling rotation of stepper motor 112. Optical scanner 76 is connected through control terminal 124 to encoder controller 122 for delivering signals thereto. An opto isolator 129 associated with proximity switches 71 and 73 is shown along with a potentiometer 130 which can be used to adjust the sensitivity of optical scanner 76. System power supply 132 is also shown.

Figure 6A:
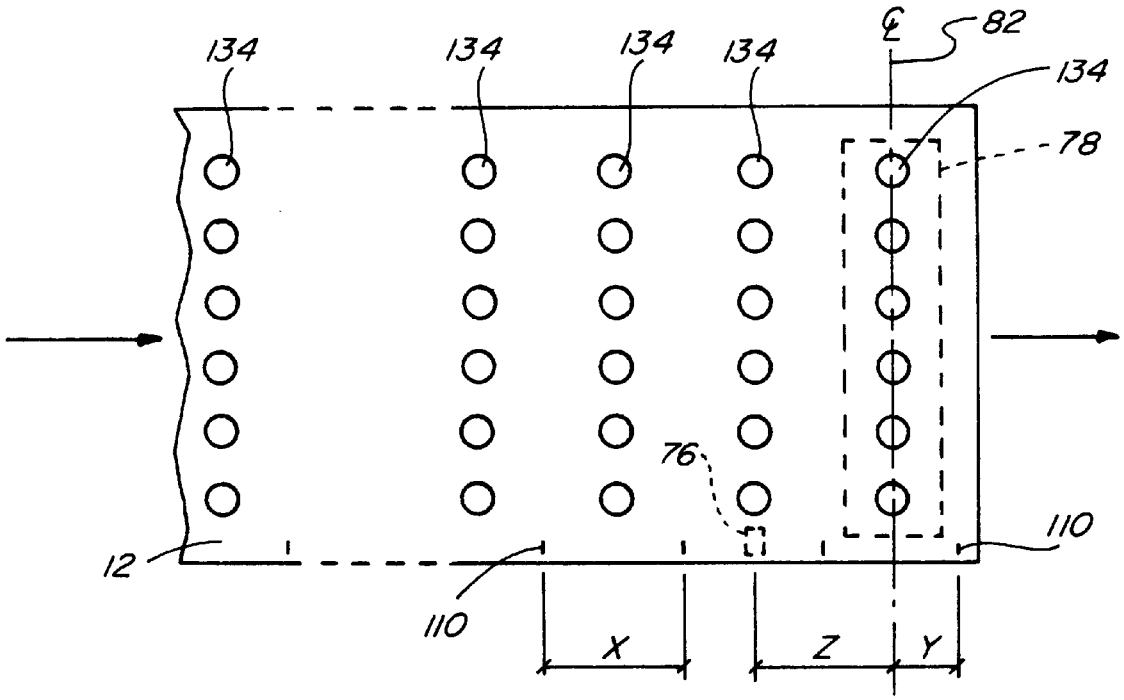
FIGS. 6A and 6B are partial top views of a metal coil illustrating exemplary operation of the press registration system of FIGS. 3–5.
Figure 6B:
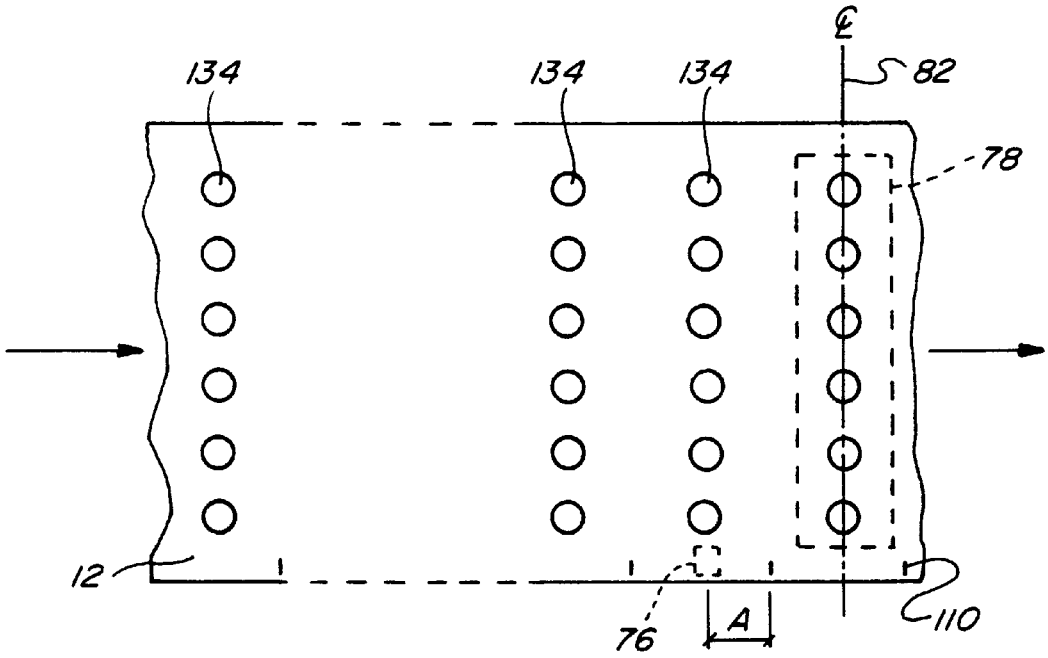

The press registration control system 115 incorporated into metal coil press machine 70 enables more accurate feed in of metal coil 12. In particular, use of press registration control system 115 prevents accumulation of feed in error which could result in defective end product. Reference is made to FIGS. 6A and 6B which depict exemplary operation using the press registration control system for a press punch operation. Optical scanner 76 and press device 78 are shown in shadow. A surface of metal coil 12 includes a repeating circular pattern 134 thereon. In this example it is desired that centerline 82 of press device 78 be located at the midpoint of a given circular pattern 134 each time a punch operation takes place so that, for example, can lids may be printed with circular pattern 134 thereon. Spaced registration marks 110 also appear on metal coil 12, successive registration marks 110 being spaced an expected predetermined distance X from each other and spaced an expected predetermined distance Y from the center point of a following circular pattern 134. For this example, the value of X is expected to be 4 inches and the value of Y is expected to be 2 inches. These values are termed expected values because it is recognized that in printing registration marks 110 on metal coil 12 there will typically be some error so that X might, for example, actually vary between 3.9 inches and 4.1 inches and Y might similarly vary between 1.95 inches and 2.05 inches. Because indexer 84 (FIG. 4) will be set to rotate a predetermined amount in attempt to feed in the nominal 4 inches of metal coil 12 between each operation of press device 78, if a press registration control system is not utilized these dimensional errors can accumulate. The distance between optical scanner 76 and press device centerline 82 is shown as Z and is assumed to be 4 inches for this example. It will generally be difficult to determine Z within tight tolerances so that inclusive in the software of processing means 116 may be an offset value which may be established by trial and error during system initialization.

FIG. 6A shows an initial position of metal coil 12 with the center of the first circular pattern 134 aligned with press device centerline 82. At this point operation of press device 78 may be initiated. This initial position could be achieved in a variety of ways including manually as well as by use of an initial feed in algorithm.

Referring to FIG. 6B general operation is explained. The overall goal of the registration control system is to assure that each time a punch operation is performed by press device 78, the offset distance between optical detection means 76 and the just passed registration mark 110 is A inches, in this case 2 inches because distance Z is four inches. If for example distance Z was 5 inches, then the desired offset distance A would be 3 inches (the difference between Z and Y). By assuring that offset distance A is always maintained at the predetermined desired value, 2 inches in this example, error will be prevented from accumulating during continuous operation of metal coil press machine 70.

Desired offset distance A is maintained as follows. When optical scanner 76 detects a registration mark 110, a pulse signal is sent to the encoder controller 122 and a counter in encoder controller 122 is reset to zero. While press device 78 is up, indexer 84 continues to rotate to feed in metal coil 12, encoder 108 sends pulse signals to encoder controller 122 the number of which are proportional to rotation of feed roller 72 and therefore proportional to feed in of metal coil 12. When press device 78 moves down for a punch operation a signal is generated by proximity switch 73 which signal interrupts the counter of encoder controller 122 and CPU 118 reads the count within encoder controller 122. The down signal from proximity switch 73 also functions as a lock out which prevents further indexing of metal coil 12 until a press device up signal is generated by proximity switch 71. CPU 118 compares the read count to a count which corresponds to desired offset distance A and a correction value is calculated based upon the difference. For example, if the read count corresponds to 2.1 inches then the difference or error would be 2.0−2.1=−0.1 inches. After such an error, if metal coil 12 were fed in 4 inches before the next operation of press device 78, then the −0.1 inch error would be continued. Accordingly, a correction of −0.1 inches needs to be made to the next index or coil feed in. CPU 118 therefore sends a −0.1 inch correction to stepper motor controller 120. Stepper motor controller 120 waits for proximity switch 71 to generate a signal which indicates an up position of press device 78 before delivering the necessary number of pulses to move stepper motor 112 far enough to retard rotation of output 98 of harmonic differential 86 by an amount which will reduce the coil feed in by 0.1 inches. The output 98 of harmonic differential 86 could also be advanced if, for example, the error were +0.1 inches. Such adjustment to the nominal index or coil infeed is made after each punch operation, thereby keeping the metal coil 12 suitably aligned for repeated infeed into press machine 70. CPU 118 can be programmed by well known techniques in order to achieve the described operation.

Figure 7:
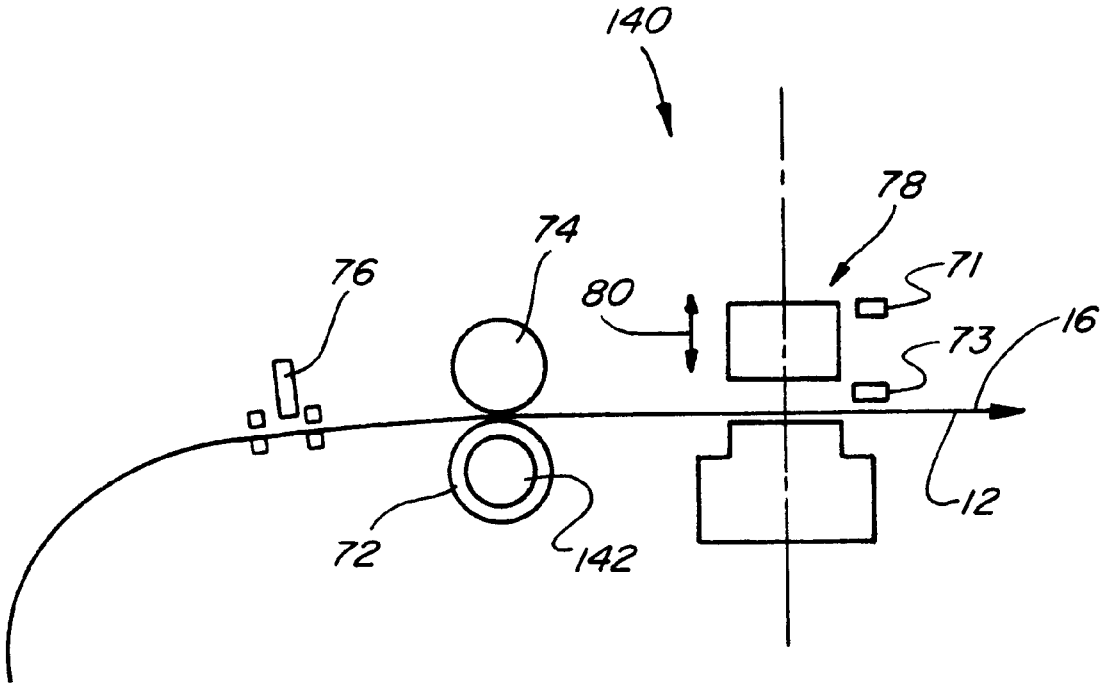
FIG. 7 is a partial schematic side view of a metal coil press machine in accordance with another embodiment of the present invention.
Figure 8:
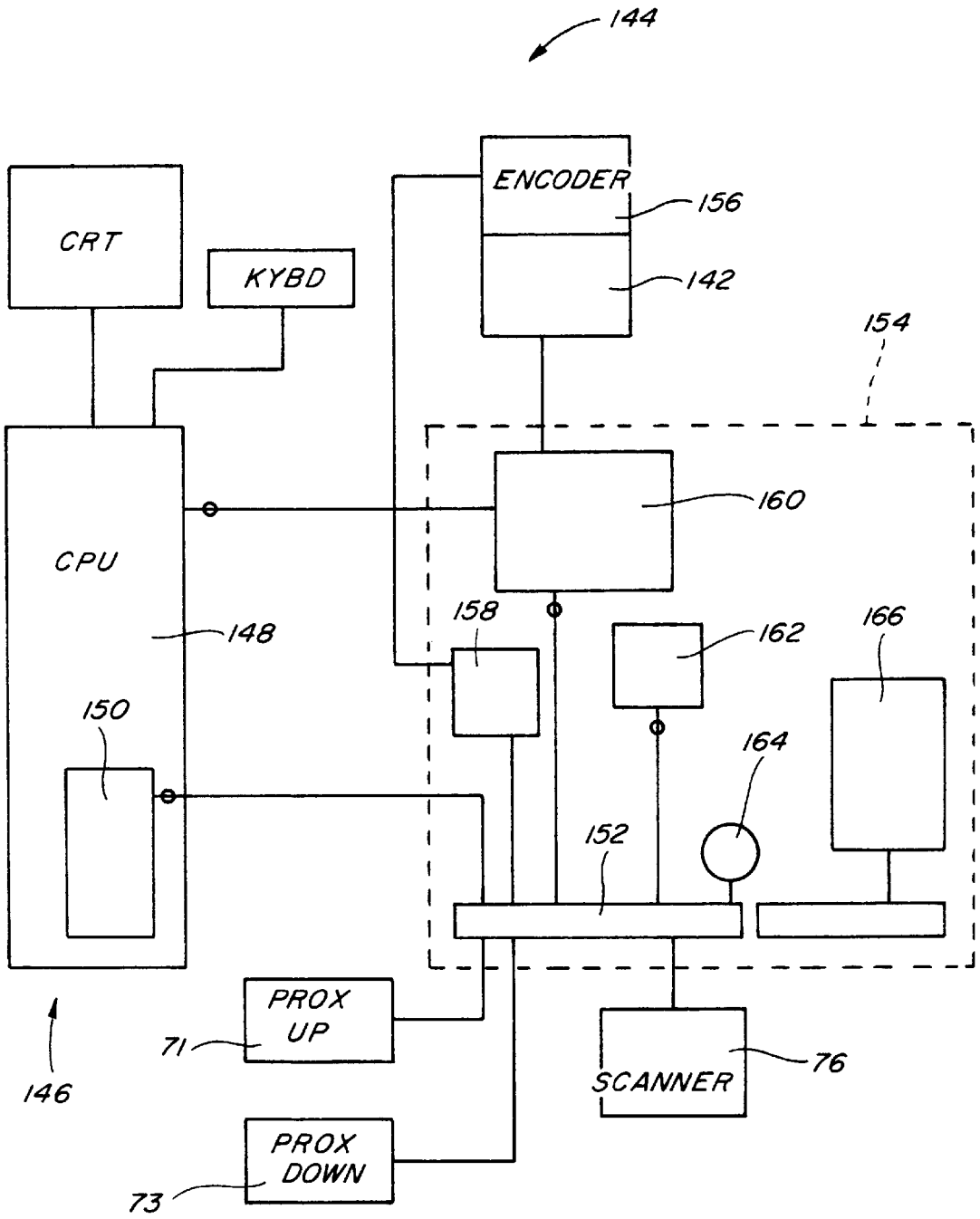
FIG. 8 is a system diagram for the metal coil press machine of FIG. 7.

Another embodiment of a press machine 140 including a press registration control system in accordance with the present invention is depicted in FIG. 7. Press machine 140 includes an optical scanner 76 located in front of feed roller 72 and nip roll 74. In some situations such positioning may be necessary due to the large amount of vibration produced by operation of press device 78. Press machine 140 also includes proximity switches 71 and 73 for monitoring the up and down position of press device 78. However, rather than include an indexer which is geared through a harmonic differential to control rotation of feed roller 72, feed roller 72 is connected for rotation by a servo motor 142. Referring to FIG. 8, a press registration control system 144 diagram is shown. Processing means 146, such as a computer having a CPU 148 including an encoder controller card 150 is provided. Proximity switches 71 and 73 are connected through control terminal 152 of control panel 154 to deliver signals indicative of the up or down position of press device 78 to CPU 148. Scanner 76 is connected through control terminal 152 to deliver signals indicative of detection of a metal coil registration mark to encoder controller 150. Servo motor 142 includes an encoder 156 for monitoring its rotation, encoder 156 being connected through a buffer 158 to control terminal 152 for delivering signals to encoder controller 150. CPU 148 is also connected to a servo motor controller 160 for controlling servo motor rotation and such servo motor controller may be considered part of processing means 146 as such term is used herein. An opto isolator 162, potentiometer 164, and system power supply 166 are also shown.

Figure 9A:
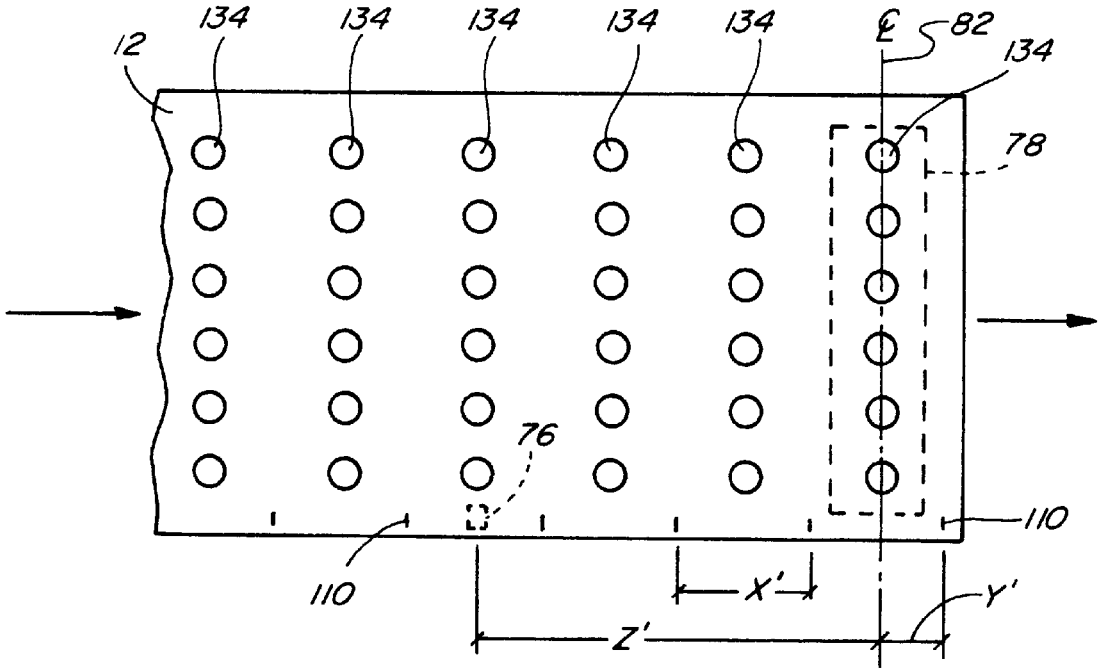
FIGS. 9A and 9B are partial top views of a metal coil illustrating exemplary operation of the metal coil press machine of FIGS. 7 and 8.

Press machine 140 of FIGS. 7 and 8 enables an exact feed in index or distance to be calculated between each operation of press device 78. Referring to FIG. 9A, metal coil 12 having repeating circular pattern 134 and spaced registration marks 110 is shown. Optical scanner 76 and press device 78 having centerline 82 are also shown. As in the previous example, it is desired that the midpoint of a circular pattern 134 be aligned with press device centerline 82 for each operation of press device 78 such that, for example, can lids having pattern 134 can be punched out of metal coil 12. A nominal or expected distance X' between registration marks is again assumed to be 4 inches and an expected distance Y' between a registration mark 110 and the center point of a following circular pattern 134 is again assumed to be 2 inches. A distance Z' between optical scanner 76 and press device centerline 82 is assumed to be 12 inches, although it is again recognized that this distance may be difficult to determine so that the system software may incorporate an adjustable offset value to be determined by trial and error adjustment during system initialization.

FIG. 9A depicts the position of metal coil 12 at start up of the machine. One technique for achieving such initial coil position would be to assume that the distance between the first four adjacent registration marks is the nominal 4 inches and to know the number of nominal indexes between feed roller 72 and optical scanner 76. The metal coil is fed into device 140 until the coil is in a position to be fed in by feed roller 72. At that point it may be known that, for example, optical scanner 76 is positioned between the second and third registration marks of the coil. Servo motor 142 is then rotated until the third registration mark 110 is detected by optical scanner 76. Assuming the distance Z' between optical scanner 76 and press centerline 82 is 12 inches and assuming that the initial distance between each adjacent pair of the first four registration marks is 4 inches, at the point when the third registration mark is aligned with optical scanner 76 it will then be known that in order to place the first pattern 134 in the position shown in FIG. 9A it will be necessary to feed the coil in an additional six inches. Accordingly, the servo motor 142 is rotated an amount sufficient to feed in metal coil 12 an additional 6 inches in order to align metal coil 12 as shown for the first punch. It is of course recognized that other techniques for initially aligning metal coil 12 could be used, including purely manual means as well as more sophisticated algorithmic means, and it is also recognized that the techniques used may vary depending upon the relative position of feed roller 72 and optical scanner 76.

Figure 9B:
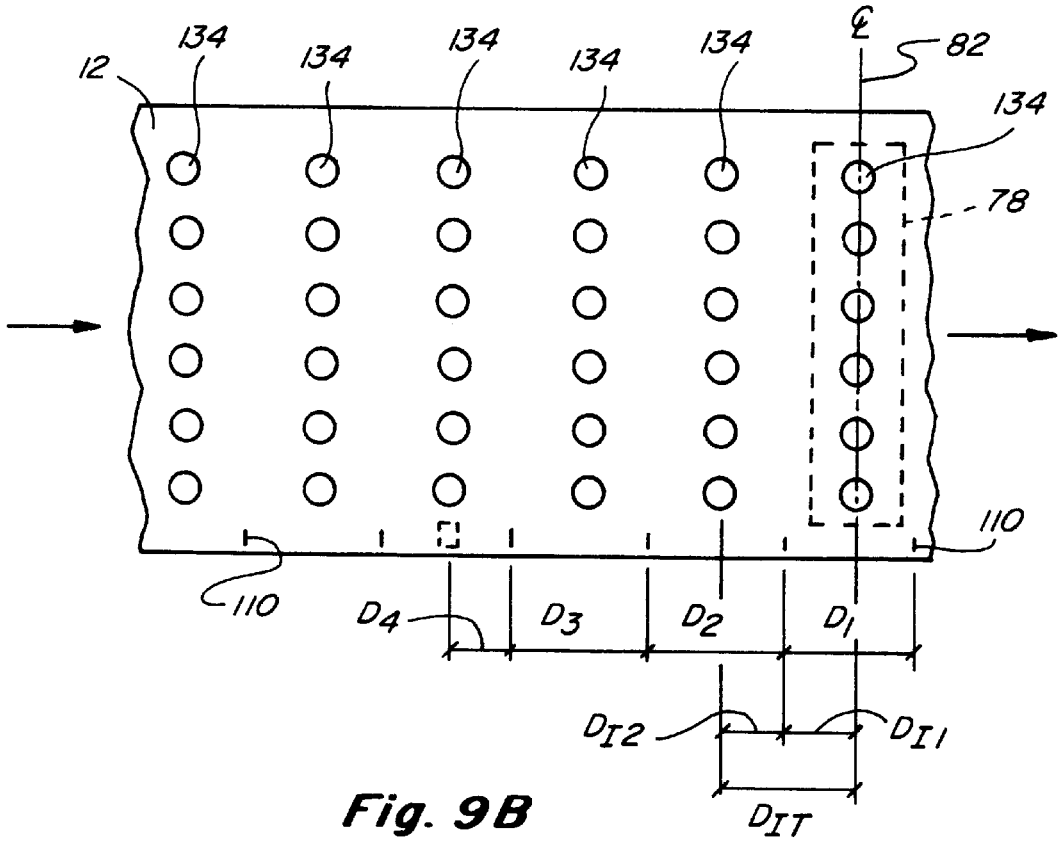

Referring to FIG. 9B, during machine operation repeated measurements are made such that at the time of each punch operation of press device 78, distances $D_1$, $D_2$, $D_3$, and $D_4$ are known, being stored in memory associated with processing means 146. From these measured distances the next index or feed in distance is calculated and servo motor 142 is rotated in accordance with the calculated distance.

The necessary distances are measured as follows, each time optical scanner 76 detects a registration mark 110 a pulse signal is sent to encoder controller 150 and a first counter is reset to zero while a second counter is interrupted and read by CPU 148. Each of the counters are incremented by pulses produced by encoder 156 during rotation of servo motor 142. Upon detection of a down position of press device 78 proximity switch 73 produces a pulse signal which resets the second counter of encoder controller 150 to zero while the first counter is interrupted and read by CPU 148. Distances $D_1$, $D_2$, and $D_3$, will therefore correspond to the sum of the two count values performed and the measured values can be stored for later use. Two counts are utilized in order to facilitate operation of press machine 140 at high speeds on the order of 300 punch operations per minute. Thus, as indicated above, at the time of each punch operation of press device 78 such distances are known. In order to calculate the appropriate coil feed in index or distance for the next punch it is necessary to calculate the distance $D_{IT}$ between press device centerline 82 and the center of the next circular pattern 134. To set the stage for such calculation, the following is known:

$$D_{IT}=D_{I1}+D_{I2};$$

and $$D_{I2}=(Y'/X')*D_2.$$

For this example (Y'/X')=0.5 and the following measured values are assumed:

$$D_1=4.05 \text{ inches};$$

$$D_2=4.02 \text{ inches};$$

$$D_3=4.02 \text{ inches};$$

and $$D_4=1.98 \text{ inches}.$$

Accordingly, $$D_{I2}=(0.5)\ (4.02)=2.01 \text{ inches}.$$

One way of calculating $D_{I1}$ would simply be to subtract D2, D3, and D4 from the distance Z'. However, this technique assumes that Z' is known precisely and that Z' never changes. In reality it would be difficult to know Z' precisely and machine operation could result in slight variations in distance Z' due, for example, to large vibrations produced by press device 78. Accordingly, the preferred technique for determining $D_{I1}$, is to use a normalizing equation with the measured values as follows:

$$D_{I1}=D_1-[D_4+(D_1-X')+(D_2-X')+(D_3-X')].$$

With the aforementioned measured values and nominal distance X' of 4 inches $D_I$, follows as:

$$D_{I1}=4.05-[1.98+0.05+0.02+0.02]$$

$$D_{I1}=4.05-[2.07]$$

$$D_{I1}=1.98 \text{ inches}$$

Accordingly, the appropriate next feed in or index $D_{IT}$ of metal coil 12 should be 1.98+2.01=3.99 inches. Once the index value $D_{IT}$ is determined CPU 148 sends the value to servo controller 160. Servo controller 160 waits for detection of a press device up signal by proximity sensor 71, which signal acts as an enable signal for servo controller 160 to rotate the servo motor an amount which will result in feed in of 3.99 inches of metal coil 12 for the next punch. The above described measurements and calculations are repeated for each operation of press device 78. This method of continuously calculating the feed in index prevents metal coil 12 from becoming improperly aligned during press machine operation so as to greatly reduce the likelihood of producing a defective end product.

It is recognized that the position of optical scanner 76 could change and that in such case the equation for determining $D_{IT}$ could be modified accordingly with little difficulty. Further, in order to account for slippage and time delays in both the computer and the optical scanner it may be desirable to include an offset value in the equation used to calculate each index. More particularly, such equation might be modified as follows:

$$D_{I1}=D_1-[(D_4+(D_1-X')+(D_2-X')+(D_3-X')+\text{OFFSET}].$$

The OFFSET value in the above equation could be preset to some initial value and during initial installation and operation of device 140 such OFFSET value could be manually adjusted until desired registration between metal coil 12 and press device 78 is achieved during such operation. The OFFSET value could thereafter be fixed to such adjusted value. Similarly, it is recognized that over time slight variations in machine timing and slippage may occur and that in order to account for such variations the OFFSET value could be adjusted at such times as are necessary.

In both metal coil press machine 70 and metal coil press machine 140, proximity switches 71 and 73 are important to maintaining timing between metal coil feed in and operation of the press device. In particular, in the case of metal coil press machine 70 no stepper motor adjustment is made until the press device is determined to be in an up position. Similarly, in metal coil press machine 140 rotation of the servo motor 142 is prevented until the press device is determined to be in an up position. As used herein, the terminology "up position" of a press device is not limited to the maximum upward position of such press device. Rather, such "up position" is intended to include any position of the press device at which it would be safe to move the metal coil traveling therethrough without damaging or otherwise interfering with the press device. Further, as used herein the terminology "down position" of a press device is not limited to the lowest downward position at which the press device contacts the metal coil passing therethrough. Rather, such "down position" is intended to include any position of the press device below which indexing of the metal coil does not occur. Although the detailed description above discusses the use of proximity switches to determine the up position and down position of the press device, it is recognized that other types of sensing devices could be utilized for detecting such up position and down position of the press device. For example, optical detectors such as photo cells could be appropriately positioned on the press device for such purposes, such optical detectors being connectable in either system 115 or system 144 in place of the proximity switches. A resolver could also be used for such purposes, the resolver being mounted to the drive shaft of the press device to constantly measure the drive shaft angle. Such drive shaft angle measurement information would be sent to a corresponding decoder which could be incorporated into either system 115 or system 144, the decoder also being connected to respective CPU 118 or 148. The decoder processor would be programmed to provide outputs at predetermined drive shaft angles which are selected as indicative of the up position and down position of the press device.

Although in the preferred embodiments it is desirable that the up position of the press device and the down position of the press device be referenced to distinct positions of the press device, it is likewise recognized that the up position and down position of the press device could be determined with reference to the same position of the press device. For example, the same proximity sensor, appropriately positioned, could be utilized to indicate both the up position and the down position of the press device in which case the press device would be considered to be in a down position whenever the proximity switch is triggered by the press device, and the press device would be considered to be in an up position as soon as the proximity switch is no longer triggered by the press device. Other sensing devices including optical detectors or a resolver could be used in the same manner.

Although both metal coil press machines 70 and 140 have been described in terms of utilizing a press punch device, it is recognized in both machines a press shear device could be substituted. Further, although the above examples describe one punch operation taking place between successive registration marks it is recognized that such number could vary.

In terms of programming associated with the processing means 116 and 146 of respective press machines 70 and 140, because of the high operating speeds of such machines, it is desirable and it may be necessary to utilize a real time kernel program to facilitate multiple tasks being performed in a quasi-parallel manner. The present invention also facilitates use of the same press machine for punching/shearing metal coils of a variety of patterns. For example, at start-up an operator may be queried for various coil specific parameters such as nominal index, index offset, maximum error, width of index mark, and number of punches between successive registration marks.

Although various aspects and embodiments of the present invention have been described in detail it is recognized that modifications or variations could be developed without departing from the spirit of the present invention.

We claim:

1. A metal coil printing mechanism for providing registration between at least two patterns to be printed on a metal coil, the metal coil printing mechanism comprising:

a speed controllable motor;

a blanket cylinder assembly including a blanket cylinder, a drive shaft extending from the blanket cylinder and connected to the motor for rotation thereby, and a gear connected to the blanket cylinder drive shaft, the blanket cylinder positionable to contact a surface of a metal coil passing thereby;

a first plate cylinder assembly including a first plate cylinder, a drive shaft extending from the first plate cylinder, and a gear connected to the first plate cylinder drive shaft and engageable with the gear of the blanket cylinder assembly for rotation therewith;

a second plate cylinder assembly including a second plate cylinder, a drive shaft extending from the second plate cylinder, a phase shifting device having an output and first and second inputs, the phase shifting device output connected to the second plate cylinder drive shaft, the first input connected to a gear which is engageable with the blanket cylinder drive shaft gear for rotation therewith;

the first plate cylinder positionable to apply a first ink pattern to a circumferential surface of the blanket cylinder and the second plate cylinder positionable to simultaneously apply a second ink pattern to the circumferential surface of the blanket cylinder; and wherein rotation of the second input of the second plate cylinder assembly phase shifting device provides adjustment of a circumferential position of the second ink pattern on the circumferential blanket cylinder surface relative to the first ink pattern.

2. The metal coil printing mechanism, as set forth in claim 1, wherein the second plate cylinder assembly phase shifting device comprises a harmonic differential.

3. The metal coil printing mechanism, as set forth in claim 1, wherein rotation of the second input of the second plate cylinder assembly phase shifting device may be made during rotation of the first input and the second output.

4. The metal coil printing mechanism, as set forth in claim 1, wherein the second input of the second plate cylinder assembly phase shifting device is manually adjustable.

5. A metal coil press registration control system for automatically adjusting feed in of a metal coil of the type having spaced registration marks on a surface thereof to a metal coil press machine of the type including a press device and an indexer, the press device operable to repetitively shear or punch the metal coil as it passes therethrough, the indexer configured to rotate a predetermined amount between each operation of the press device in attempt to feed in the metal coil a predetermined nominal distance, the press registration control system comprising:

optical detection means positioned adjacent the metal coil surface and aligned for detecting registration marks on the surface of the metal coil as they pass thereby;

a phase shifting device including a first input, a second input, and an output, the first input connected to an output shaft of the indexer for rotation therewith;

a coil feed roller including a drive shaft extending therefrom, the drive shaft connected to the output of the phase shifting device for rotation therewith;

an encoder connected to monitor rotation of the coil feed roller;

a position controllable motor connected for rotating the second input of the phase shifting device;

a first sensing device for detecting a down position of the press device with respect to the surface of the metal coil;

processing means connected to each of the optical detection means, the encoder, and the first sensing device for receiving signals therefrom, the processing means further connected for controlling rotation of the position controllable motor; and wherein the processing means is operable to measure coil feed in occurring between detection of a registration mark by the optical detection means and detection of a down position of the press device by the first sensing device, the processing means further operable to compare the measured coil feed in to a predetermined distance and to calculate a feed in correction based upon the comparison, the processing means operable to effect rotation of the position controllable motor by an amount corresponding to the calculated feed in correction only after the press device is no longer in the down position.

6. The metal coil press registration control system, as set forth in claim 5, wherein the phase shifting device is a harmonic differential gearbox.

7. The metal coil press registration control system, as set forth in claim 6, wherein a ratio of the first input to the output of the harmonic differential gearbox is I/O, the first input thereof including a O toothed pulley associated therewith and the output thereof including an I toothed pulley associated therewith.

8. The metal coil press registration control system, as set forth in claim 5, wherein the predetermined distance is half the predetermined nominal distance.

9. The metal coil press registration control system, as set forth in claim 5, wherein the position controllable motor is a stepper motor.

10. The metal coil press registration control system, as set forth in claim 5, wherein the indexer is a servo motor.

11. The metal coil press registration control system, as set forth in claim 5, wherein the indexer is a mechanical indexer.

12. The metal coil press registration control system, as set forth in claim 5, wherein the press device operates independently of the press registration control system.

13. The metal coil press registration control system, as set forth in claim 5, wherein the processing means comprises a computer including an encoder controller card and a stepper motor controller card.

14. The metal coil press registration control system, as set forth in claim 5, further comprising:

a second sensing device for detecting when the press device is in an up position with respect to the surface of the metal coil, the up position being defined with respect to a position which is further from the surface of the metal coil than the down position, the second sensing device connected to the processing means; and wherein the processing means is operable to effect rotation of the position controllable motor only after detection of the up position of the press device by the second sensing device.

15. The metal coil press registration control system, as set forth in claim 14, wherein the first sensing device is a proximity switch and the second sensing device is a proximity switch.

16. The metal coil press registration control system, as set forth in claim 5, wherein the first sensing device is a resolver associated with a drive shaft of the press device, the resolver connected to a corresponding decoder which in turn is connected to the processing means.

17. A method for providing adjustment to feed in of a metal coil of the type having spaced registration marks on a surface thereof to a metal coil press machine of the type including a press device and an indexer, the press device operable to repetitively shear or punch the metal coil as it passes therethrough, the indexer configured to rotate a predetermined amount between each operation of the press device in attempt to feed in the metal coil a predetermined nominal distance, the method comprising the steps of:

(a) providing a phase shifting device geared between an output of the indexer and a metal coil feed roller;

(b) producing a signal indicative of alignment of a registration mark with a predetermined point;

(c) producing a signal indicative of a down position of the press device;

(d) measuring a coil feed in distance occurring between production of the step (b) signal and production of the step (c) signal;

(e) comparing the distance measured in step (d) to a predetermined distance;

(f) calculating a feed in adjustment based upon the comparison made in step (e); and (g) rotating an input of the phase shifting device an amount corresponding to the calculated feed in correction after the press device is no longer in the down position.

18. The method, as set forth in claim 17, further including the step of:

(h) producing a signal indicative of an up position of the press device; and wherein step (g) is only performed after production of the signal of step (h).

19. The method, as set forth in claim 17, wherein the phase shifting device is a harmonic differential gearbox.

20. The method, as set forth in claim 17, wherein the signal of step (b) is produced by a proximity switch.

21. The method, as set forth in claim 17, wherein step (d) includes utilizing an encoder to establish a count value.

22. The method, as set forth in claim 17, wherein the predetermined distance of step (e) is an expected distance between a registration mark and a desired position of a punch centerline on the coil.

23. The method, as set forth in claim 17, wherein the predetermined distance of step (e) is an expected distance between a registration mark and a desired position of a shear centerline on the coil.

24. A metal coil press machine for use in association with a metal coil of the type having spaced registration marks on a surface thereof, comprising:

a press device operable to repetitively shear or punch the metal coil as it passes therethrough;

a coil feed roller having a drive shaft associated therewith;

a servo motor connected to the feed roller drive shaft for controlling rotation thereof;

an encoder associated with the servo motor for monitoring rotation thereof;

optical detection means positioned adjacent the metal coil surface and aligned for detecting registration marks on the surface of the metal coil as they pass thereby;

a first sensing device for detecting a down position of the press device with respect to the surface of the metal coil;

processing means connected to each of the optical detection means, the encoder, and the first sensing device for receiving signals therefrom, the processing means connected for controlling rotation of the servo motor;

wherein during machine operation the processing means is operable to repeatedly measure and store both a first coil feed in distance and a second coil feed in distance, the first foil feed in distance occurring between detection of a registration mark by the optical detection means and detection of the down position of the press device by the first sensing device, the second coil feed in distance occurring between detection of the down position of the press device by the first sensing device and detection of the next successive registration mark by the optical detection means; and wherein the processing means is further operable to calculate a coil feed in index for each successive operation of the press device based upon the above measurements.

25. The metal coil press machine, as set forth in claim 24, wherein in calculating a given feed in index the processing means is operable to calculate a first index distance which is the distance between a centerline of the press device when in a down position to the next registration mark on the surface of the metal coil with respect to the press centerline.

26. The metal coil press machine, as set forth in claim 25, wherein in calculating the given feed in index the processing means is further operable to calculate a second index distance which is a predetermined percentage of a distance between the next two registration marks on the surface of the coil with respect to the press centerline, wherein the given feed in index is calculated as the sum of the first index distance and the second index distance.

27. The metal coil press machine, as set forth in claim 24, wherein the first position sensing device is a proximity switch.

28. The metal coil press machine, as set forth in claim 24, wherein the processing means comprises a computer including an encoder controller card.

29. The metal coil press machine, as set forth in claim 24, wherein rotation of the servo motor is inhibited at least until after the press device is no longer in a down position.

30. A method for repeatedly determining desired feed in of a metal coil of the type having spaced registration marks on a surface thereof into a metal coil press machine including a press device operable to repetitively shear or punch the metal coil as it passes therethrough, the method comprising the steps of:

(a) providing coil feed in means including a coil feed roller having a drive shaft connected to a servo motor;

(b) producing a signal each time one of the coil registration marks is located at a predetermined point;

(c) producing a signal each time the press device is in a down position;

(d) repeatedly measuring a coil feed in distance occurring between production of a step (b) signal and production of a step (c) signal;

(e) repeatedly measuring a coil feed in distance occurring between production of a step (c) signal and production of a step (b) signal; and (f) repeatedly calculating desired feed in as a function of the measurements made in steps (d) and (e).

31. The method, as set forth in claim 30, including the step of:

(g) producing a signal each time the press device is in an up position; and (h) rotating the servo motor each time desired feed in is calculated in step (f) and only after production of a signal in step (g).

32. The method, as set forth in claim 30, wherein the signal of step (b) is produced by optical detection means.

33. The method, as set forth in claim 30, wherein the signal of step (c) is produced by a proximity switch.

34. The method, as set forth in claim 30, wherein the signal of step (c) is produced by an optical detector.

* * * * *